United States Patent [19]

Stroman

[11] 4,227,559

[45] Oct. 14, 1980

[54] DUAL ATTITUDE GOLF BAG

[76] Inventor: Marlin H. Stroman, 142 Phillips, Clawson, Mich. 48017

[21] Appl. No.: 44,984

[22] Filed: Jun. 4, 1979

[51] Int. Cl.[3] ..... A63B 55/00

[52] U.S. Cl. ..... 150/1.5 R; 264/177 R

[58] Field of Search ..... 150/1.5 R, 1.5 B, 1.5 C; 264/177 R, 210.2, 295

[56] References Cited

U.S. PATENT DOCUMENTS

| | | | |
|---|---|---|---|
| 1,437,349 | 11/1922 | Moore | 150/1.5 R |
| 1,920,308 | 8/1933 | Hiles | 150/1.5 R |
| 2,009,072 | 7/1935 | Sampson | 150/1.5 R |
| 3,143,154 | 8/1964 | Best | 150/52 R |

FOREIGN PATENT DOCUMENTS

| | | | |
|---|---|---|---|
| 428118 | 6/1911 | France | 150/1.5 R |

*Primary Examiner*—Donald F. Norton
*Attorney, Agent, or Firm*—William L. Fisher

[57] ABSTRACT

Improvement in a dual attitude golf bag for carrying a set of golf clubs having an in-use attitude for golf playing and a space saving flat-lying attitude for storage and transport, the improvement comprising a flexible one-piece extruded core for the golf bag consisting of a normally flat-lying shell and a plurality of side by side separator tubes integrally joined to the shell, the core having the same two attitudes as that of the golf bag, the set of golf clubs being individually contained in the separator tubes in each of the two attitudes of the core, the core, in the in-use attitude of the golf bag, having a cylindrical form in which the separator tubes are disposed in side by side substantially rigid abutment to each other so as to impart compressive strength and rigidity to the core in its in-use attitude, said separator tubes being open ended at the bottom ends thereof so that, in the flat-lying attitude of the golf bag, the heads of the golf clubs are capable of commonly engaging the top end of the core for better weight distribution, managing and handling of the set of golf clubs.

2 Claims, 10 Drawing Figures

DUAL ATTITUDE GOLF BAG

My invention relates to golf bags.

The principal object of my invention is the provision of an improvement in a dual attitude golf bag which decreases the cost of manufacture of the latter and has decided advantages in each attitude thereof.

The foregoing object of my invention and the advantages thereof will become apparent during the course of the following description, taken in conjunction with the accompanying drawings, in which:

FIGS. 1-3 are, respectively, front, side and rear elevational views of an improved dual attitude golf bag embodying my invention shown in its in-use attitude;

FIGS. 4 and 5 are, respectively, top and bottom plan views of the structure of FIG. 1 taken, respectively, on the lines 4—4 and 5—5 thereof;

Figure 1:
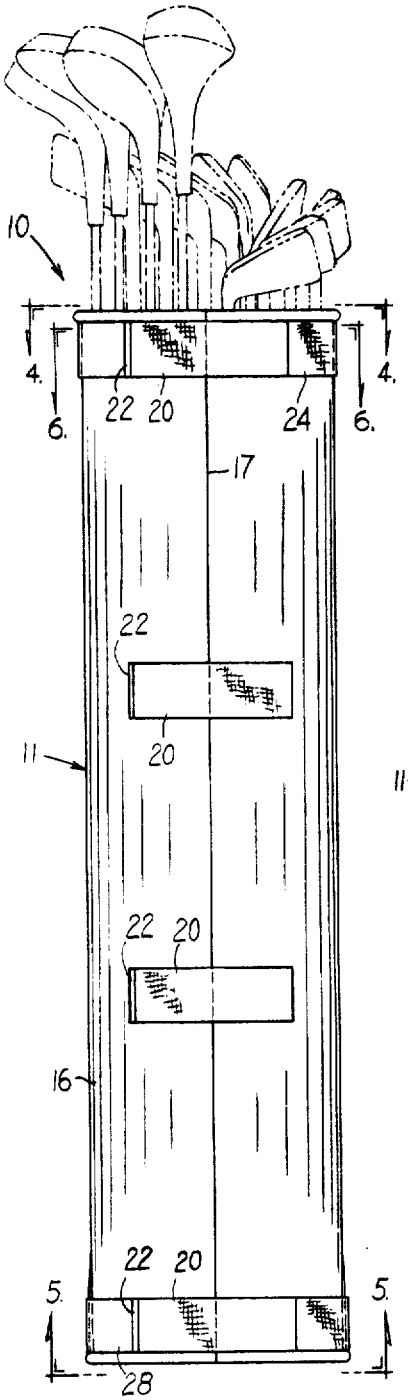
Figure 2:
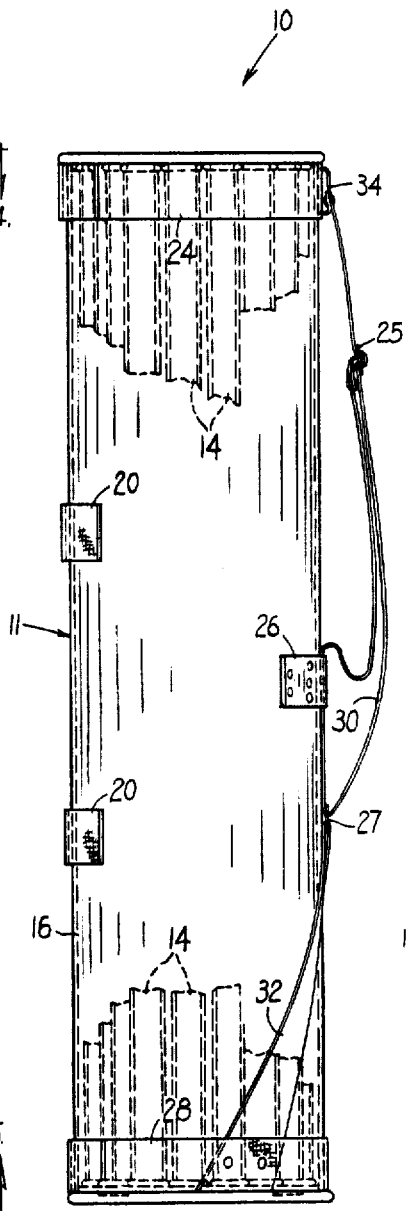
Figure 3:
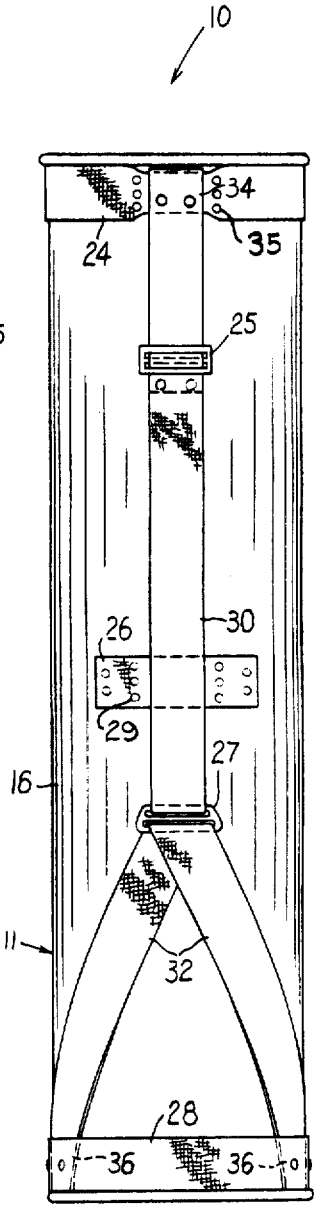
Figure 4:
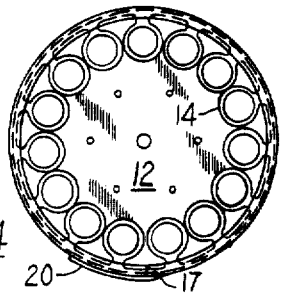
Figure 5:
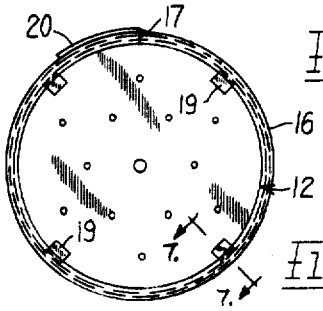

Referring to the drawings in greater detail, 10 generally designates said dual attitude golf bag which, in the instance, comprises a body part of core designated 11 and another separable bottom part designated 12. Said body part 11 consists of a flexible shell 18, to the inside of which is integrally joined, as at 13, a plurality of side by side tubular members or separator tubes 14 for individually holding a set of golf clubs (shown in broken lines) for said golf bag 10; said shell 18 and members 14 are integrally extruded of suitable plastic, as is well Each separator tube is open ended at the bottom end of the core 11 so that in the flat-lying attitude thereof the shafts of the golf clubs can slide through the bottom ends of the separator tubes until the heads thereof commonly engage the top end of the core 11 which is advantageous as will appear. The shell 18 is covered, in the instance, on its outside by an appearance covering 16 which may be of leather or the like fastened thereto, as at 15 and 23. Said appearance covering is provided with rolled edges, as at 21, at the top and bottom thereof.

Figure 9:
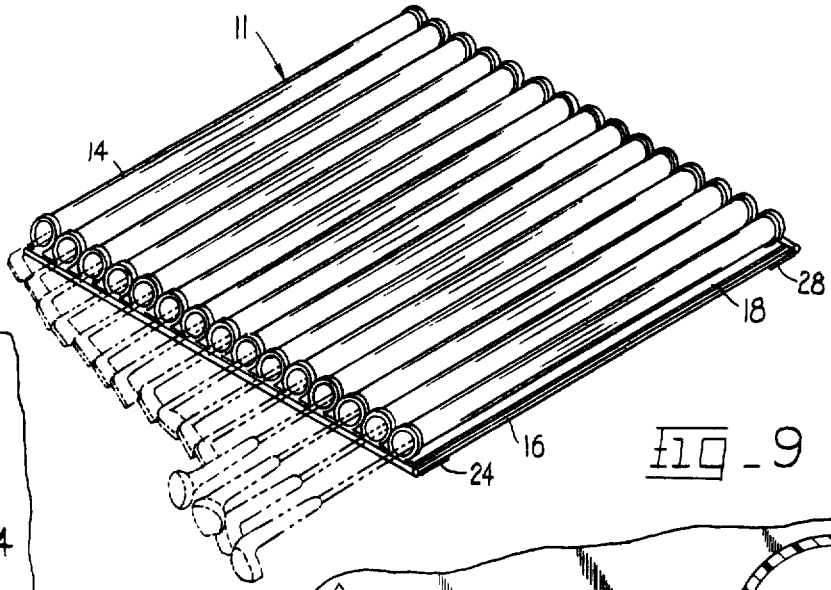
FIG. 9 is a perspective view of said embodiment shown in its space-saving attitude.
Figure 7:
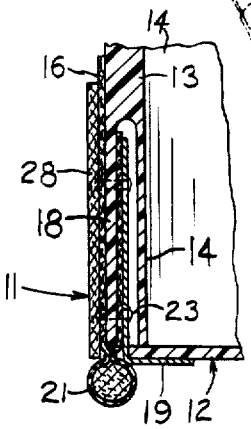
FIG. 7 is a fragmentary sectional view of the structure of FIG. 5 taken on the line 7—7 thereof.
Figure 6:
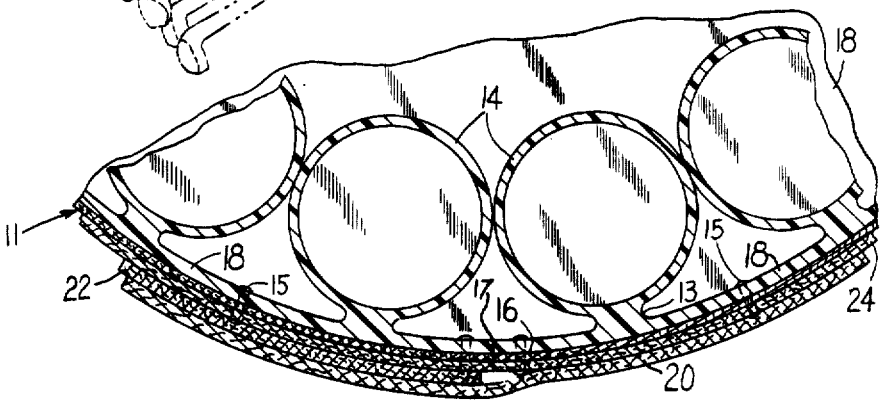
FIG. 6 is a fragmentary sectional view of the structure of FIG. 1 taken on the line 6—6 thereof.
Figure 10:
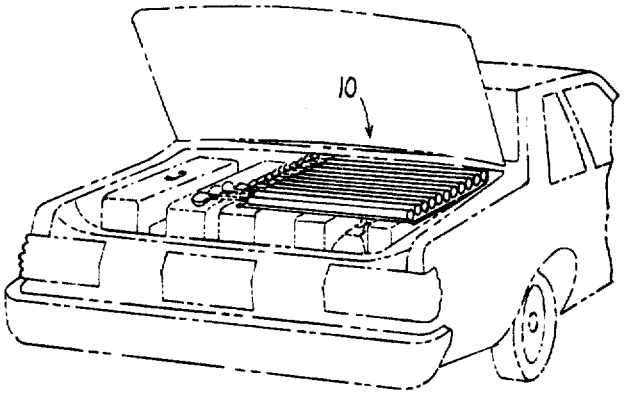
FIG. 10 is another view of the structure of FIG. 9 shown in the trunk of an automobile.
Figure 8:
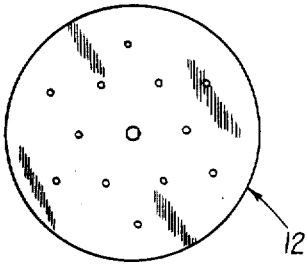
FIG. 8 is a plan view of a part of said embodiment.

Said golf bag 10 is capable of assuming two attitudes depending upon the user's particular needs at the time, i.e. an in-use attitude as shown in FIGS. 1-7 and a flat-lying space-saving attitude as shown in FIGS. 8-10.

In its in-use attitude said golf bag 10 is wrapped about said bottom part 12 which assists in holding it, in the instance, in a cylindrical in-use shape and forms, via the side edges thereof, a lengthwise extending seam 17. Said bottom part 12 forms a common bottom for the plurality of tubular members 14 and is attached to said body part 11 by circumferentially spaced apart clips 19 fastened, as at 23, to said shell 18. Said tubular members 14 pressed together in said in-use attitude which strengthens the golf bag 10 for its intended use; when the golf bag 10 is in its flat-lying attitude said tubular members 14 separate from each other. Said body part 11 is provided with releasable closure means 20,22 to permit the body part 11 to open so that the golf bag 10 can assume its flat-lying attitude. Said golf bag 10 is provided, in the instance, with a handle for carrying purposes consisting of straps 30 and 32 joined by a buckle 27; the strap 30 is lengthwise adjustable by a buckle 25. Both ends of the strap 32 are joined to the lower end of said body part 11 by a hold-down strap 28 fastened to said shell 18, as at 36. The uppermost end of the strap 30 is joined to the upper end of said body part 11 by a hold-down strap 24 fastened to said shell 18, as at 35. The lower looped end of said strap 30 is joined to the middle of said body part 11 by a hold-down strap 26 fastened to said shell 18, as at 29.

Said golf bag 10 is capable of being transported to a golf course in its space-saving attitude as shown in FIGS. 9 and 10 and there assembled into its in-use attitude by forming said body part 11 into a container with the bottom part 12 held in place by the clips 19 and with said fasteners 20, 22 closed over said seam 17 as shown in FIGS. 1-7. The process is reversed when the golfer stores the golf bag 10 for transport from the golf course. The golf clubs remain in said golf bag 10 in either of its two attitudes. In FIG. 9 the heads of the golf clubs are shown extended from the top end of the core for purposes of clarity, but, as previously mentioned, such heads are capable of commonly engaging the top end of said core 11 for better weight distribution, handling and managing of the set of golf clubs in the flat-lying attitude of said golf bag 10.

It will thus be seen that there has been provided by my invention improvement in a dual attitude golf bag in which the object hereinabove set forth, together with many thoroughly practical advantages, has been successfully achieved. For example, in the conventional cylindrical or in-use attitude said golf bag 10, while serving the normal function of golf bags in general has greatly increased compressive strength and rigidity for a dual attitude golf bag. However, said golf bag 10 is conveniently convertible to a flat-lying attitude for packing or stowing for transport in the trunk compartment of automobiles and because the heads of the golf clubs are capable of commonly engaging the top end of the core 11 they have better weight distribution and are more easily handled and managed as mentioned. In such attitude it is far more adaptable to limited space availability as the net cubic space occupied is much less than in the conventional cylindrical attitude. With the present trend toward smaller automobiles the instant invention is particularly advantageous in that a foursome of golfers can transport four golf bags in the trunk space of a single automobile. While a preferred embodiment of my invention has been shown and described, it is to be understood that changes and variations may be resorted to without departing from the spirit of my invention as defined by the appended claims.

What I claim is:

1. Improvement in a dual attitude golf bag for carrying a set of golf clubs having an in-use attitude for golf playing and a space saving flat-lying attitude for storage and transport, said improvement comprising a flexible one-piece extruded core for said golf bag having the same two attitudes as the latter and consisting of a normally flat-lying shell and a plurality of side by side separator tubes integrally joined to said shell, the set of golf clubs, in each of the two attitudes of said core, being individually contained in said separator tubes, said core, in the in-use attitude of said golf bag, having a cylindrical form in which said separator tubes are disposed in side by side substantially rigid abutment to each other so as to impart compressive strength and rigidity to said golf bag, and said separator tubes being open ended at the bottom ends thereof so that, in the flat-lying attitude of said golf bag, the heads of the golf clubs are capable of commonly engaging the top end of said core for better weight distribution, managing and handling of the set of golf clubs.

2. Improvement in a method of forming a dual attitude golf bag for carrying a set of golf clubs, said golf bag having an in-use attitude for golf playing and a space saving flat-lying attitude for storage and transport, said improvement comprising the step of extruding a flexible one-piece core for said golf bag consisting of a normally flat-lying shell and a plurality of side by side separator tubes integrally joined to said shell, said core having the same two attitudes as that of said golf bag, the set of golf clubs being individually contained in said separator tubes in each of the two attitudes of said core, the step of rolling said core into a cylindrical form in which said separator tubes are disposed in side by side substantially rigid abutment to each other so as to impart compressive strength and rigidity to said golf bag in its in-use attitude, and said separator tubes being open ended at the bottom ends thereof so that, in the flat-lying attitude of said golf bag, the heads of the golf clubs are capable of commonly engaging the top end of said core for better weight distribution, managing and handling of the set of golf clubs.

* * * * *